US006634339B2

(12) United States Patent
He et al.

(10) Patent No.: US 6,634,339 B2
(45) Date of Patent: Oct. 21, 2003

(54) FRONT END RATE SHAPING VALVE CONCEPT FOR A FUEL INJECTION SYSTEM

(75) Inventors: Junru He, Normal, IL (US); Edward Gillis, Bloomington, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/000,624

(22) Filed: Oct. 31, 2001

(65) Prior Publication Data

US 2003/0079724 A1 May 1, 2003

(51) Int. Cl.[7] ..... F02M 37/04
(52) U.S. Cl. ..... 123/496; 123/300
(58) Field of Search ..... 123/300, 299, 123/456, 496, 457, 459; 239/88–96

(56) References Cited

U.S. PATENT DOCUMENTS

| | | | | |
|---|---|---|---|---|
| 3,473,523 A | | 10/1969 | Hilborn | |
| 4,211,203 A | * | 7/1980 | Kobayashi | 123/496 |
| 4,224,903 A | * | 9/1980 | Mowbray | 123/300 |
| 4,289,098 A | * | 9/1981 | Norberg et al. | 123/299 |
| 4,389,987 A | * | 6/1983 | Frankle et al. | 123/300 |
| 4,437,444 A | | 3/1984 | Yasuhara | |
| 5,086,742 A | * | 2/1992 | Vogtmann | 123/449 |
| 5,195,487 A | * | 3/1993 | Zurner et al. | 123/300 |
| 5,197,437 A | * | 3/1993 | Dahlmann | 123/467 |
| 5,390,692 A | | 2/1995 | Jones et al. | |
| 5,462,030 A | | 10/1995 | Shinogle | |
| 5,503,127 A | | 4/1996 | Djordjevic | |
| 5,715,795 A | | 2/1998 | Guentert et al. | |
| 5,842,452 A | | 12/1998 | Pattanaik | |
| 6,085,719 A | | 7/2000 | Heinz et al. | |
| 6,247,450 B1 | * | 6/2001 | Jiang | 123/446 |
| 6,360,727 B1 | * | 3/2002 | DeLuca | 123/496 |

OTHER PUBLICATIONS

U.S. patent application Ser. No. 09/742,570, filed Dec. 20, 2000.
U.S. patent application Ser. No. 09/740,533, filed Dec. 19, 2000.

* cited by examiner

*Primary Examiner*—Carl S. Miller
(74) *Attorney, Agent, or Firm*—Liell & McNeil

(57) ABSTRACT

A nozzle supply valve is positioned in the nozzle supply passage of a fuel injector, and is constructed to generate a boot shaped rate trace mechanically. The goal of the concept is to restrict the flow area during the first boot step and release the flow area restriction in the second step. During the first stage of injection, the flow to the nozzle only goes through a restricted orifice. When the line pressure is high enough to overcome the valve movement pressure spring preload, the nozzle supply valve moves to an unrestricted position, and the boot shaped rate trace is formed. Since this boot shape rate trace is generated mechanically, it can be combined with fuel injectors having a direct control needle valve in order to get different rate traces including, ramps, squares, pilots, posts and other split injections.

20 Claims, 5 Drawing Sheets

FRONT END RATE SHAPING VALVE CONCEPT FOR A FUEL INJECTION SYSTEM

TECHNICAL FIELD

The present invention relates generally to front end rate shaping during fuel injection events, and more particularly to a valve concept for producing boot shaped injection rate trace profiles.

BACKGROUND

Over the years, engineers have come to recognize that undesirable emissions can be lowered at different operating conditions by producing particular injection rate trace profiles. Among the various rate shape profiles are so called ramps, boots, squares and splits, etc. There are numerous references describing various fuel injection systems and the means by which they can produce one or more of the above identified rate shaping traces. For instance, commonly owned U.S. Pat. No. 5,462,030 to Shinogle shows a spring loaded device that can be employed in a fuel injection system in order to produce a front end rate shape that is somewhere between a boot and split injection rate trace. During an injection event, as fuel pressure is building after the nozzle outlet has opened, the Shinogle device includes a small spring loaded accumulater volume that opens at some pre-determined pressure. As fuel flows into the accumulater volume, the pressure, and hence the flow rate, at the nozzle outlet briefly drops. After the accumulator volume is full, the pressure and flow rate out of the nozzle outlet rise in a somewhat conventional manner. The end result is a particular front end rate shaping that is a function of several factors including the accumulator volume, its opening pressure, etc. The Shinogle device also appears to include some adjustment means for adjusting the rate shape produced by the device. While the Shinogle device appears to have a promise, there remains room for improvement.

The present invention is directed to these and other problems associated with producing front end rate shaping in fuel injection systems.

SUMMARY OF THE INVENTION

In one aspect, a fuel injector includes an injector body that defines a nozzle supply passage and a nozzle outlet. A needle valve member is positioned in the injector body and is moveable between an open position in which the nozzle supply passage is open to the nozzle outlet, and a closed position in which the nozzle supply passage is closed to the nozzle outlet. A nozzle supply valve member is positioned in the injector body and includes an opening hydraulic surface exposed to fluid pressure in an upstream portion of the nozzle supply passage. The nozzle supply valve member is moveable between a first position in which the nozzle supply passage is relatively restricted, and a second position in which the nozzle supply passage is relatively unrestricted.

In another aspect, a fuel injection system includes a nozzle supply valve moveable between a first position in which a nozzle supply passage is relatively restricted, and a second position in which the nozzle supply passage is relatively unrestricted. The nozzle supply valve is biased by a first biaser toward its first position when fluid pressure in the nozzle supply passage upstream from the nozzle supply valve is below a first predetermined pressure. A nozzle outlet valve is moveable between an open position in which the nozzle supply passage is open to a nozzle outlet, and a closed position in which the nozzle supply passage is closed to the nozzle outlet. The nozzle outlet valve is biased by a second biaser toward its closed position when fluid pressure in the nozzle supply passage between the nozzle supply valve and the nozzle outlet valve is below a second predetermined pressure. The second predetermined pressure is lower than the first predetermined pressure.

In still another aspect, a method of injecting fuel includes a step of opening a nozzle outlet at least in part by raising fuel pressure in a nozzle supply passage above a first predetermined pressure, and moving a needle valve member from a closed position toward an open position. Fuel flow in the nozzle supply passage is restricted. The flow restriction in the nozzle supply passage is then removed at least in part by increasing fuel pressure in the nozzle supply passage above a second predetermined pressure, which is greater than the first predetermined pressure, and by moving a nozzle supply valve member from a first position toward a second position.

DETAILED DESCRIPTION

Figure 1:
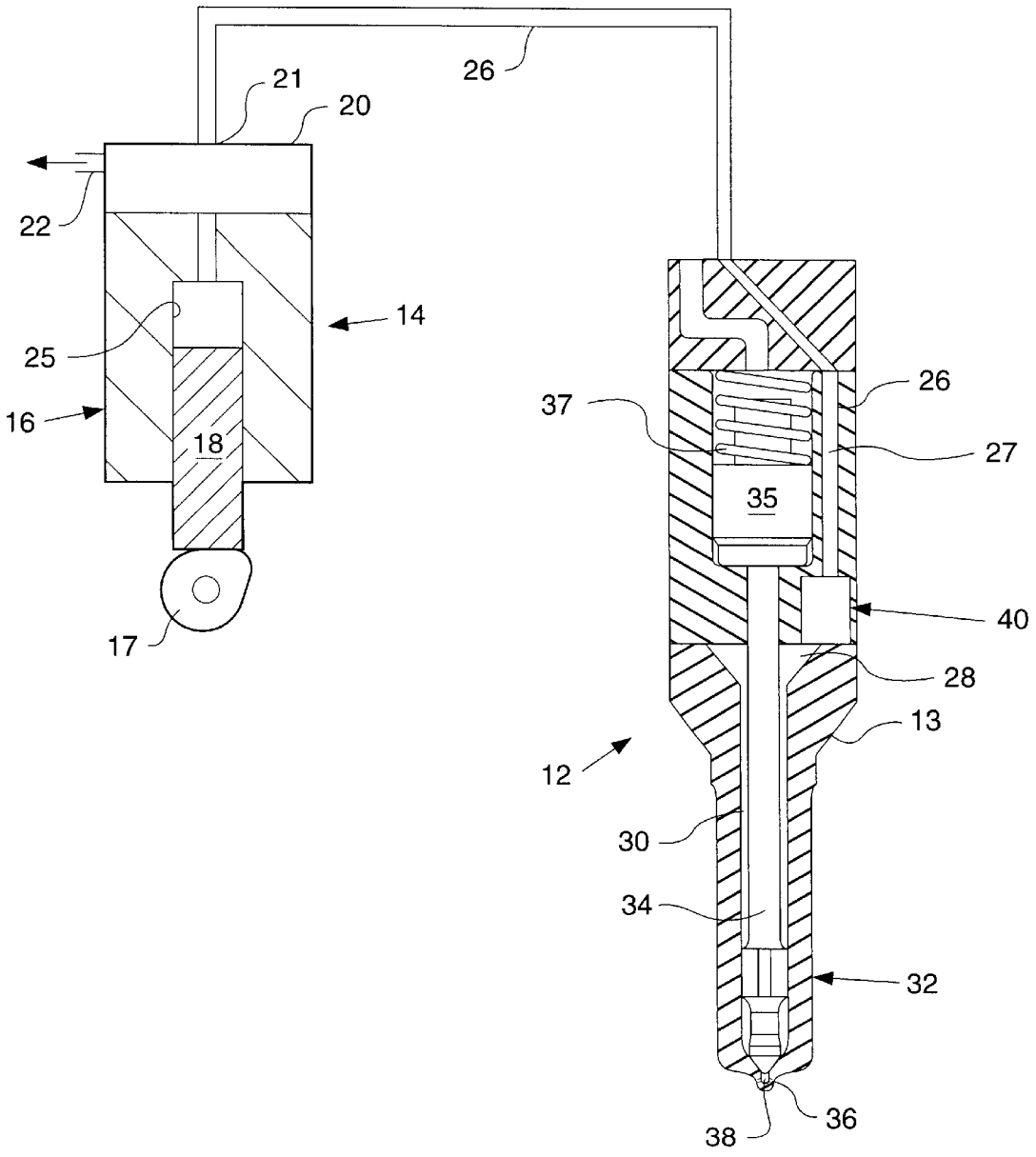
FIG. 1 is a schematic illustration of a fuel injection system according to one aspect of the present invention.

Referring to FIG. 1, a fuel injection system 10 includes a fuel injector 12 and a fuel pressurizer 14, which in this example is a unit pump 16. A rotating cam 17 causes a plunger 18 to reciprocate in unit pump 16 to displace fluid into and out of a fuel pressurization chamber 25. Unit pump 16 includes a conventional spill valve 20 which typically has two positions. In a first position, fuel is displaced from fuel pressurization chamber 25 at low pressure to a pump inlet/spill port 22, for recirculation. When plunger 18 is undergoing its pumping stroke and spill valve 20 is closed, fuel in fuel pressurization chamber 25 is pressurized to injection levels and displaced toward fuel injector 12 via a pump outlet 21 and a nozzle supply passage 26.

Figure 2:
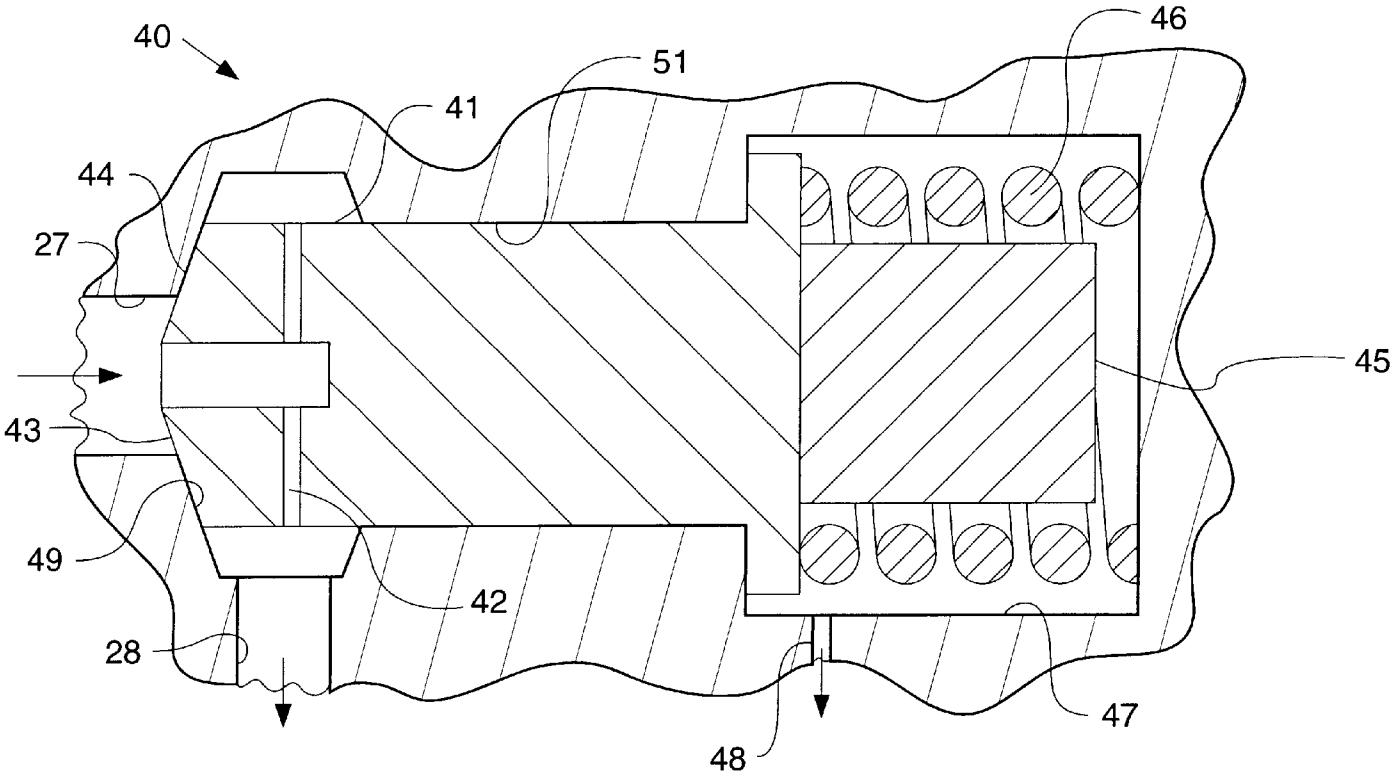
FIG. 2 is a sectioned side diagrammatic view of a nozzle supply valve according to the preferred embodiment of the present invention.

Referring now in addition to FIG. 2, nozzle supply passage 26 can be thought of as including an upstream portion 27 separated from a downstream portion 28 by a nozzle supply valve 40. Those skilled in the art will appreciate that nozzle supply valve 40 could be positioned at any suitable location in nozzle supply passage 26, but is preferably located within injector body 12 in close proximity to a nozzle chamber 30. When nozzle supply valve 40 is in its closed position as shown in FIG. 2, upstream portion 27 of nozzle supply passage 26 is connected to downstream portion 28 via a relatively restricted passage 42 defined by nozzle supply valve member 41. Nozzle supply valve member 41 is biased toward this closed position in which its valve surface 44 is in contact with a conical valve seat 49 by a biaser, which is preferably a compressed spring 46. When fuel pressure acting on an opening hydraulic surface 43 is above a first predetermined pressure, nozzle supply valve member 41 moves toward an open position against the action of spring biaser 46. The maximum travel of nozzle supply valve member 41 is defined by a stop piece 45 which is preferably located in a spring chamber 47 along with biasing spring 46. Spring chamber 47 is vented in order to prevent hydraulic locking via a vent 48. Nozzle supply valve member 41 is guided in its movement by preferably having a matched clearance with a guide bore 51 defined by injector body 12. Thus, when nozzle supply valve member 41 is in its closed position, as shown, nozzle supply passage 26 has a relatively restricted flow area due to restricted passage 42. When nozzle supply valve member 41 moves to its open position, nozzle supply passage 26 has a relatively unrestricted flow area.

Fuel injection system 10 also includes a nozzle outlet valve 32 that is positioned in injector body 12 between nozzle supply valve 40 and nozzle outlet 36. Nozzle outlet valve 32 includes a needle valve member 34 that is biased to a downward closed position in a conventional manner by a biaser, which is preferably a compressed spring 37. Those skilled in the art will appreciate that the identified biasers 37 and 46 could be any suitable force generating means, including but not limited to other mechanical device biasers, magnetic biasers and hydraulic biasers. When needle valve member 34 is in its downward closed position, sac 38 and nozzle outlet 36 are blocked from fluid communication with nozzle chamber 30. Needle valve member 34 includes an opening hydraulic surface 35 exposed to fluid pressure in a nozzle chamber 30. When fuel pressure in nozzle chamber 30 is above a second predetermined pressure, the fluid pressure on opening hydraulic surface 35 causes needle valve member 34 to lift to an open position that fluidly connects nozzle outlet 36 to nozzle chamber 30. The first predetermined pressure at which nozzle supply valve 40 moves to its unrestricted position is preferably substantially higher than the second predetermined pressure at which nozzle outlet valve 32 moves toward its open position. For instance, the valve movement pressure (VMP) of the nozzle supply valve 40 could be on the order of about 100 MPa, while the valve opening pressure (VOP) of the nozzle outlet valve might be on the order of about 40 MPa. Thus, when in operation, nozzle outlet valve 32 will open first, and fuel will be supplied to nozzle outlet 36 via a relatively restricted flow area, and then flow will become unrestricted as pressure builds to a point that opens moves nozzle supply valve 40 to remove the flow restriction in nozzle supply passage 26.

Figure 4:
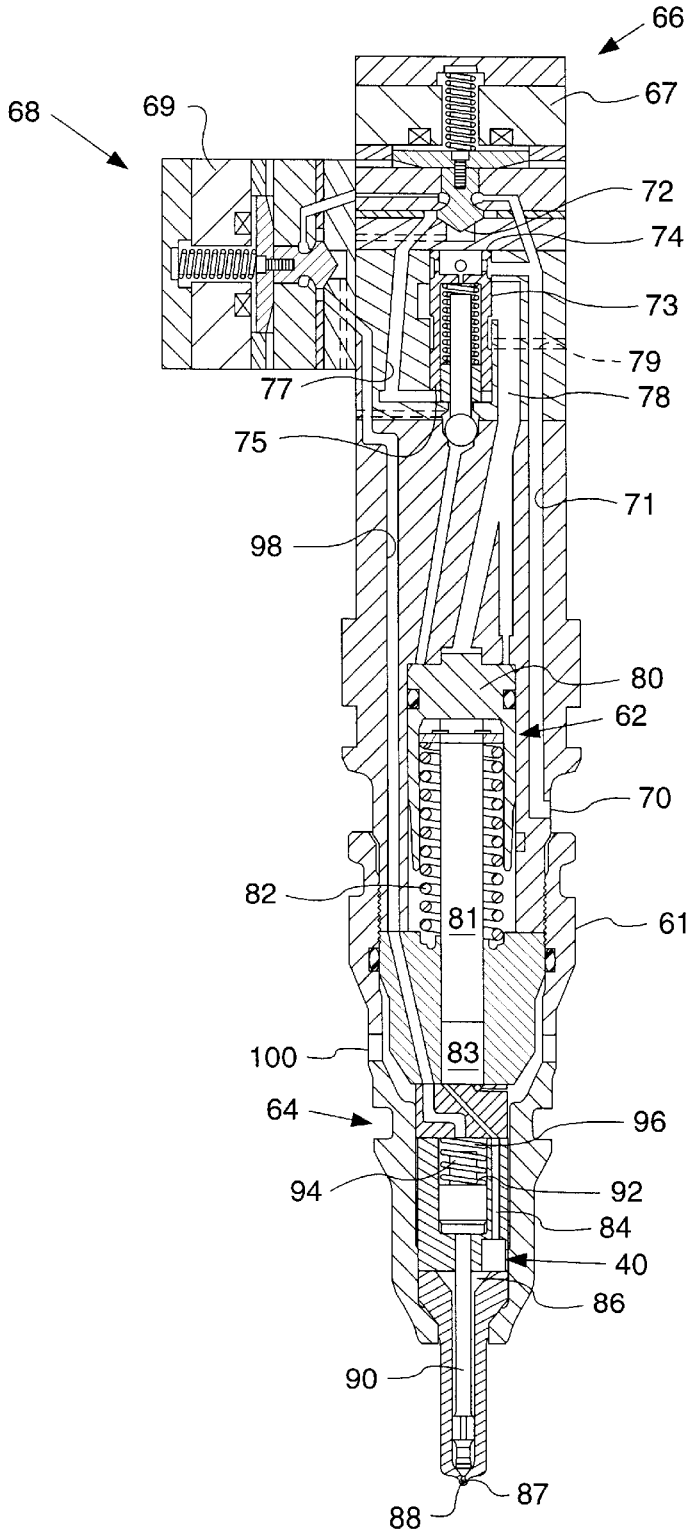
FIG. 4 is a sectioned side diagrammatic view of a hydraulically actuated fuel injector according to another embodiment of the present invention.

Referring now to FIG. 4, an alternative embodiment of the present invention includes a hydraulically actuated fuel injector 60 that includes a substantially identical nozzle supply valve 40 positioned in its nozzle supply passage 84. Fuel injector 60 includes a hydraulic fuel pressurizer 62, a direct control nozzle outlet valve 64, a flow control valve assembly 66 and a needle control valve 68 that are all positioned in and/or are attached to injector body 61 in a conventional manner. When in operation, flow control valve assembly 66 alternately exposes an intensifier piston 80 to a source of high pressure fluid and a drain in order to cause plunger 81 to reciprocate. Needle control valve 68 alternately exposes a closing hydraulic surface 92 of a needle valve member 90 to either high pressure or low pressure in order to open and close nozzle outlet 87. Thus, flow control valve assembly 66 controls the pressurization of fuel in fuel injector 60, while needle control valve 68 controls the timing, and to some extent rate shaping, of each injection event.

Flow control valve assembly 66 includes an electrical actuator 67, which like all of the electrical actuators identified with respect to the present invention could be a solenoid as illustrated, a piezo actuator or possibly some other suitable actuator such as a voice coil. Electrical actuator 67 is operably coupled to a pilot valve member 72 that is trapped between upper and lower seats to alternately connect a pressure control passage 77 to either high pressure or low pressure. Flow control valve assembly 66 also includes a spool valve member 73 with a biasing hydraulic surface 74 always exposed to high pressure, and a control hydraulic surface 75 exposed to fluid pressure in pressure control passage 77. Pilot valve member 72 is normally biased to a downward position that fluidly connects pressure control passage 77 to high pressure via high pressure passage 71 to cause spool valve member 73 to be biased toward its upward position, as shown, by a biasing spring. When in this position, an actuation fluid passage 78 is connected to a low pressure drain 79 via an annulus feature on the outer surface of spool valve member 73. When electrical actuator 67 is energized to pull pilot valve member 72 upward, pressure control passage 77 becomes fluidly connected to a low pressure vent, which allows the continuous high pressure on biasing hydraulic surface 74 to push spool valve member 73 downward to close drain 79 and open actuation fluid passage 78 to high pressure passage 71 via another annulus on the outer surface of spool valve member 73.

The upper hydraulic surface of intensifier piston 80 is exposed to fluid pressure in actuation fluid passage 78. When actuation fluid passage 78 is connected to fluid drain 79, a return spring 82 tends to bias and push intensifier piston 80 and plunger 81 upward toward their retracted positions, as shown. When actuation fluid passage 78 is connected to high pressure passage 71, intensifier piston 80 and plunger 81 are driven downward to compress and pressurize fuel in a fuel pressurization chamber 83. When plunger 81 is undergoing its upward return stroke, fresh low pressure fuel is drawn into fuel pressurization chamber 83 from fuel inlet 100 past a check valve that prevents reversed flow.

Fuel pressurization chamber 83 is connected to one end of a nozzle supply passage 84 that includes at its other end a nozzle chamber 86. Preferably, a nozzle supply valve 40 having a structure substantially identical to that previously described is positioned in nozzle supply passage 84 between fuel pressurization chamber 83 and nozzle chamber 86. When needle valve member 90 is in its downward position as shown, sac 88 and nozzle outlet 87 are closed to nozzle chamber 86. When needle valve member 90 lifts to its open position, nozzle outlet 87 and sac 88 are then open to nozzle chamber 86.

Needle valve member 90 includes an opening hydraulic surface exposed to fluid pressure in nozzle chamber 86, and a closing hydraulic surface 92 exposed to fluid pressure in a needle control chamber 94. Needle valve member 90 is normally biased to its downward position by an appropriate biaser, such as a compressed biasing spring 96 as shown. Needle control chamber 94 is fluidly connected to needle control valve 68 via a needle control passage 98. Needle control valve 68 includes an electrical actuator 69, and has a structure substantially similar to the pilot valve portion of flow control assembly 66. When electrical actuator 69 is deenergized, needle control passage 98 is connected to high pressure passage 71, which results in needle valve member 90 being held in its downward closed position even in the presence of high pressure fuel in nozzle chamber 86. When needle control valve 68 is energized, needle control passage 98 becomes connected to a source of low pressure which will allow needle valve member 90 to lift toward its open position against the action of biasing spring 96 provided that fuel pressure in nozzle chamber 86 is above a valve opening pressure. Like the previous embodiment, the valve opening pressure of needle valve member 90 is preferably substantially lower than the valve movement pressure of nozzle supply valve 40.

INDUSTRIAL APPLICABILITY

Figure 3:
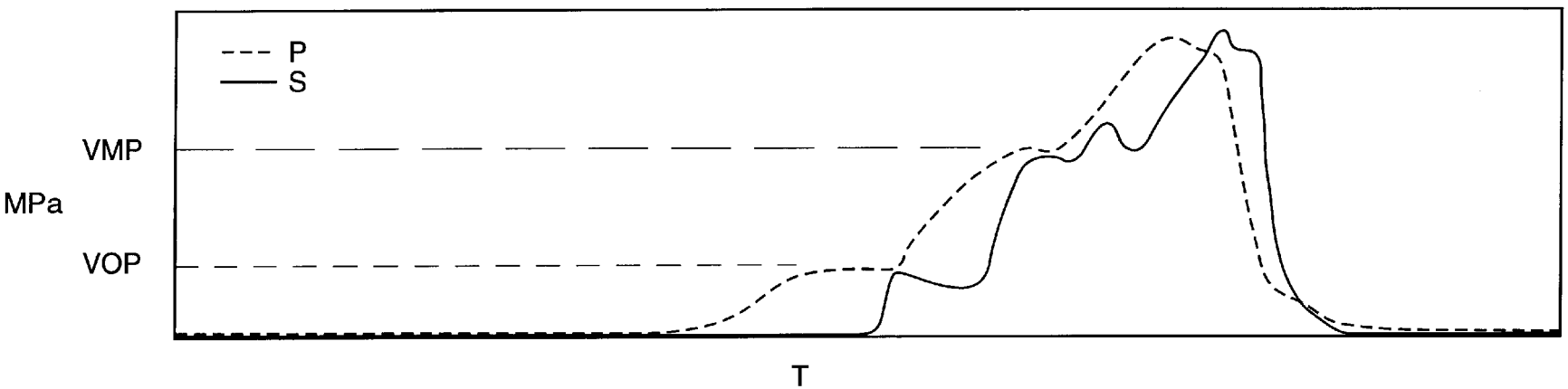
FIG. 3 is a graph of plunger pressure and sac pressure verses time for an example fuel injection event according to the present invention.

Referring again to FIGS. 1 and 2, and in addition to FIG. 3, a pressure trace for an example fuel injection event according to the present invention is illustrated. Those skilled in the art will appreciate that an injection rate trace shape will have a shape very similar to the sac pressure rate trace illustrated in FIG. 3. This attribute allows a curve that is indicative of the injection flow rate to be mapped on top of the same graph that indicates fuel pressure in the upstream portion of the nozzle supply passage, which is identified in the graph as being at the plunger surface. Each injection event is initiated by the lobe of cam 17 turning to cause plunger 18 to begin displacing fuel from fuel pressurization chamber 25. The pressurization portion of the injection event begins when spill valve 20 is closed. At that time, fuel pressure adjacent plunger 18 begins to rise. However, because fuel pressure has not yet reached the valve opening pressure of nozzle outlet valve 32, the nozzle outlet valve remains closed and sac pressure remains low. As plunger 18 continues its pumping stroke, fuel pressure eventually exceeds the valve opening pressure (VOP) of nozzle outlet valve 32 causing it to open which results in the beginning of nozzle spray out of nozzle outlets 36 and a rise in sac pressure. This portion of the injection event is commonly referred to as the toe portion of a boot shaped injection event.

As plunger 18 continues its pumping stroke, fuel pressure soon exceeds the valve movement pressure of the nozzle supply valve 40 causing it to move from its restricted position to its unrestricted position. This in turn results in the injection rate and the sac pressure ramping up accordingly for the instep portion of the boot rate shape. The injection event then continues at or near a maximum fuel pressure. Shortly before the desired end to the injection event, spill valve 20 is again opened to spill fuel pressure in fuel pressurization chamber 25 and nozzle supply passage 26. This drop in fuel pressure causes needle valve member 30 and outlet valve 32 to close under the action of biasing spring 37 to end the injection event.

Figure 5:
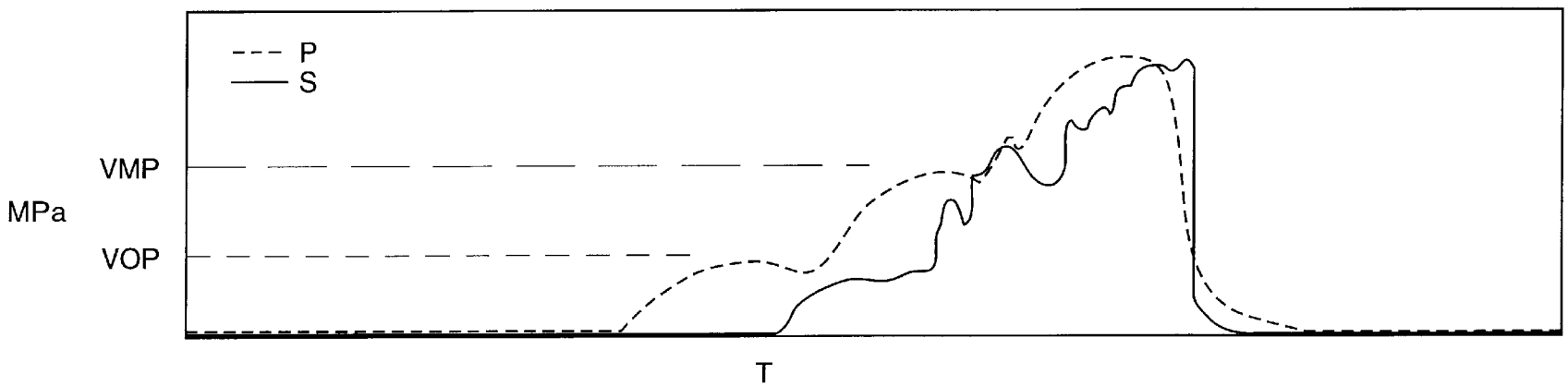
FIG. 5 is a graph of plunger pressure and sac pressure verses time for an example fuel injection event according to the present invention.

Referring now to FIGS. 4 and 5, between injection events, electrical actuator 67 and 69 are deenergized; this results in actuation fluid passage 78 being connected to low pressure drain 79, and needle control passage 98 being connected to high pressure passage 71. Those skilled in the art will recognize that fuel injector 60 is capable of doing several different types of injection rate traces, including boot shaped injections, ramps, squares, splits, etc. In order to produce a boot shaped injection of the type shown in FIG. 5, both electrical actuators 67 and 69 are energized close in time. This connects needle control passage 98 to low pressure so that the only force holding needle valve member 90 in its downward closed position is biasing spring 96. When electrical actuator 67 is energized, pressure control passage 77 becomes connected to low pressure which cause spool valve member 73 to be pushed downward to closed low pressure drain 79, and open actuation fluid passage 78 to high pressure passage 71. When this occurs, high pressure flows into actuation fluid passage 78 and pushes intensifier piston 80 and plunger 81 downward to compress fuel in fuel pressurization chamber 83.

As plunger 81 begins its downward stroke, fuel pressure in nozzle supply passage 84 and fuel pressurization chamber 83 builds. When that pressure exceeds the valve opening pressure of nozzle outlet valve 64, needle valve member 90 lifts to its open position to commence the spraying of fuel, beginning the toe portion of a boot shaped rate event. As plunger 81 continues its pumping stroke, fuel pressure continues to rise and eventually exceeds the valve movement pressure of nozzle supply valve 40, causing it to move from its restricted position to an unrestricted position. This begins the instep portion of the boot, and the injection event continues in a conventional manner. Shortly before the desired amount of fuel has been injected, electrical actuator 69 is deenergized to reconnect needle control passage 98 to high pressure in order to quickly push needle valve member 90 downward toward its closed position due to the high pressure now acting on closing hydraulic surface 92.

Thus in both embodiments of the present invention, the nozzle outlet is opened by raising fuel pressure in a nozzle supply passage above a first predetermined pressure and by moving the needle valve member from a closed position to an open position. When fuel commences to spray, it is supplied to the nozzle outlet via the nozzle supply passage which has a flow restriction. During the injection event, the flow restriction is removed by increasing fuel pressure in the nozzle supply passage above a second predetermined pressure which causes the nozzle supply valve member to move from a first or restricted position to a second or unrestricted position. In both of the illustrated embodiments, the step of raising fuel pressure and the step of increasing fuel pressure are accomplished by driving a plunger away from a retracted position toward an advanced position. However, those skilled in the art will appreciate that the present invention could be used in conjunction with a common rail system in which some intervening device (e.g. valve) between the common rail and the fuel injector causes fuel pressure in the nozzle supply passage to build gradually in a way that mimics the pressure build up produced by a reciprocating plunger.

In both embodiments of the present invention, a nozzle supply valve having a similar structure is illustrated in which the restricted passage is defined by the nozzle supply valve member itself. Those skilled in the art will appreciate that the restricted passage according to the present invention need not necessarily be defined by the nozzle supply valve member, but instead could be defined by the injector body, or by both the valve member and the injector body. Preferably, the unrestricted flow through the nozzle supply passage is produced by moving the nozzle supply valve member away from a conical valve seat to open relatively unrestricted flow across the valve seat. In the illustrated embodiments, the various biasers are shown as compressed springs; however, those skilled in the art will appreciate that other biasers, such as other mechanical devices, magnetic devices or possibly even hydraulic fluid pressure could be used to bias the various members toward one position. The present invention is aimed at creating an ability to generate boot shaped rate traces mechanically. The idea of this concept is to restrict the flow area during the first boot step and then release or unrestrict the flow area in the second boot step. The concept is simple in design and in manufacture.

It should be understood that the above description is intended for illustrative purposes only, and is not intended to limit the scope of the present invention in any way. Thus, those skilled in the art will appreciate that other aspects, objects and advantages of this invention can be obtained from a study of the drawings, the disclosure and the appended claims.

What is claimed is:

1. A fuel injector comprising:

an injector body defining a nozzle supply passage and a nozzle outlet;

a needle valve member positioned in said injector body, and being movable between an open position in which said nozzle supply passage is open to said nozzle outlet, and a closed position in which said nozzle supply passage is closed to said nozzle outlet;

a nozzle supply valve member positioned in said nozzle supply passage of said injector body and including an opening hydraulic surface exposed to fluid pressure in an upstream portion of said nozzle supply passage, and being moveable between a first position in which said nozzle supply passage is relatively restricted via a restricted passage, and a second position in which said nozzle supply passage is relatively unrestricted via said restricted passage and a flowpath defined between an outer surface of said nozzle supply valve member and said injector body.

2. The fuel injector of claim 1 including a first biaser positioned in said injector body and operably coupled to bias said needle valve member toward said closed position; and a second biaser positioned in said injector body and being operably coupled to bias said nozzle supply valve member toward said first position.

3. The fuel injector of claim 2 wherein at least one of said first biaser and said second biaser includes at least one compressed spring.

4. The fuel injector of claim 1 wherein said nozzle supply passage includes said nozzle supply valve member defining said restricted passage.

5. The fuel injector of claim 1 wherein said injector body includes a conical valve seat that is a portion of said nozzle supply passage; and said nozzle supply valve member being in contact with said conical valve seat when in said first position.

6. The fuel injector of claim 1 wherein said needle valve member has a valve opening pressure; and said nozzle supply valve member has a valve movement pressure that is greater than said valve opening pressure.

7. The fuel injector of claim 1 including a fuel pressurizer fluidly connected to said nozzle supply passage.

8. The fuel injector of claim 7 wherein said fuel pressurizer includes a reciprocating plunger that defines a portion of a fuel pressurization chamber fluidly connected to one end of said nozzle supply passage.

9. A fuel injection system comprising:

a nozzle supply valve moveable between a first position in which a nozzle supply passage is relatively restricted via a restricted passage and a second position in which said nozzle supply passage is relatively unrestricted via said restricted passage and a flowpath defined between an outer surface of a nozzle supply valve member and an injector body;

said nozzle supply valve being biased by a first biaser toward said first position when fluid pressure in said nozzle supply passage upstream from said nozzle supply valve is below a first predetermined pressure;

a nozzle outlet valve moveable between an open position in which said nozzle supply passage is open to a nozzle outlet, and a closed position in which said nozzle supply passage is closed to said nozzle outlet; and said nozzle outlet valve being biased by a second biaser toward said closed position when fluid pressure in said nozzle supply passage between said nozzle supply valve and said nozzle outlet valve is below a second predetermined pressure, which is lower than said first predetermined pressure.

10. The fuel injection system of claim 9 wherein at least one of said first biaser and said second biaser includes a compressed spring.

11. The fuel injection system of claim 9 wherein a portion of said nozzle supply passage is a said restricted passage which is defined by said valve member.

12. The fuel injection system of claim 11 wherein said valve member includes an opening hydraulic surface exposed to fluid pressure in said nozzle supply passage upstream from said valve member.

13. The fuel injection system of claim 12 wherein said valve member is in contact with a conical valve seat, which is a portion of said nozzle supply passage, when in said first position.

14. The fuel injection system of claim 9 including a fuel pressurizer fluidly connected to said nozzle supply passage.

15. The fuel injection system of claim 14 wherein said fuel pressurizer includes a reciprocating plunger that defines a fuel pressurization chamber fluidly connected to one end of said nozzle supply passage.

16. A method of injecting fuel, comprising the steps of:

opening a nozzle outlet at least in part by raising fuel pressure in a nozzle supply passage above a first predetermined pressure and moving a needle valve member from a closed position toward an open position;

restricting fuel flow in the nozzle supply passage via a restricted passage;

removing the flow restriction in the nozzle supply passage at least in part by increasing fuel pressure in the nozzle supply passage above a second predetermined pressure, which is greater than the first predetermined pressure, and moving a nozzle supply valve member from a first position toward a second position so that said nozzle supply passage includes the restricted passage and a flowpath defined between an outer surface of a nozzle supply valve member and an injector body.

17. The method of claim 16 wherein said step of raising fuel pressure and said step of increasing fuel pressure are accomplished at least in part by driving a plunger away from a retracted position toward an advanced position.

18. The method of claim 17 wherein said step of moving a nozzle supply valve member includes a step of opening fuel flow across a conical valve seat that is a portion of the nozzle supply passage.

19. The method of claim 18 wherein said step of restricting fuel flow includes channeling fuel from an upstream portion of the nozzle supply passage to a downstream portion via the restricted passage, which is defined by the nozzle supply valve member.

20. The method of claim 19 wherein said step of restricting fuel flow includes a step of biasing the nozzle supply valve member toward its first position; and said step of removing the flow restriction includes a step of exposing an opening hydraulic surface on the nozzle supply valve member to fuel pressure in an upstream portion of the nozzle supply passage.

* * * * *